US007536738B2

(12) United States Patent
Richards et al.

(10) Patent No.: US 7,536,738 B2
(45) Date of Patent: May 26, 2009

(54) PATIENT HELPER APPARATUS

(75) Inventors: Sandy Richards, Pershing, IN (US); Darrell Borgman, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 381 days.

(21) Appl. No.: 11/349,393

(22) Filed: Feb. 7, 2006

(65) Prior Publication Data

US 2006/0179576 A1 Aug. 17, 2006

Related U.S. Application Data

(60) Provisional application No. 60/653,705, filed on Feb. 17, 2005.

(51) Int. Cl.
*A61G 7/053* (2006.01)
*A61G 7/14* (2006.01)

(52) U.S. Cl. ..... 5/662; 5/84.1

(58) Field of Classification Search ..... 5/662, 5/84.1, 85.1, 81.1 R, 86.1
See application file for complete search history.

(56) References Cited

U.S. PATENT DOCUMENTS 4,202,062 A 5/1980 Marcyan
4,253,207 A 3/1981 Marcyan
4,340,984 A 7/1982 Marcyan
4,593,422 A 6/1986 Wolpert, Jr. et al.
4,847,930 A 7/1989 Spath
4,932,090 A * 6/1990 Johansson ..... 5/662
5,836,026 A 11/1998 Reed
6,141,806 A 11/2000 Bobey et al.
6,216,293 B1 4/2001 Ruschke
6,240,583 B1 6/2001 Brooke et al.
6,397,416 B2 6/2002 Brooke et al.

FOREIGN PATENT DOCUMENTS

AU 591951 B2 12/1989
EP 0610664 8/1994
WO WO 2004/060257 7/2004

OTHER PUBLICATIONS

Magnum II Bariatric Patient Care System, Hill-Rom Company, Inc., Bateville, IN, 2001 (4 pages).
Installation Instructions for the Total Care Patient Helper, Texas Medical Industries, Inc., date unknown (2 pages).
OSI Patient Helper for Hill-Rom TotalCare, Orthopedic System, Inc., date unknown (2 pages).

* cited by examiner

*Primary Examiner*—Alexander Grosz
(74) *Attorney, Agent, or Firm*—Barnes & Thornburg LLP

(57) ABSTRACT

A patient helper apparatus that is attachable to a hospital bed is provided. The apparatus includes a bracket that is mountable on the hospital bed, a support arm rotatably mountable on the bracket, and a handle assembly that can be gripped by a patient.

18 Claims, 4 Drawing Sheets

PATIENT HELPER APPARATUS

BACKGROUND

This application claims the benefit of U.S. Provisional Patent Application Ser. No. 60/653,705, filed Feb. 17, 2005, which is incorporated herein by this reference.

The present invention relates to patient helpers and, more particularly, to patient helpers that are suitable for use with bariatric patients.

Patient helpers are often attached to a hospital bed and are used by the patient when the patient is repositioning themselves or during ingress or egress from the bed. Patient helpers typically include a support structure that is mounted directly to the hospital bed. A handle or "trapeze" hangs down from the support structure and is grippable by the patient to assist the patient during movement. The load placed on such a patient helper by a bariatric patient can be significantly greater than the loads generated by other patients.

SUMMARY

The present invention may comprise one or more of the features recited in the appended claims and/or one or more of the following features or combinations thereof.

One embodiment of the invention takes the form of a patient helper apparatus that is attachable to a hospital bed. The apparatus includes a bracket that is mountable on the hospital bed and defines a vertical axis. A support arm is rotatably mounted on the bracket and includes a first section that defines a horizontal length. A handle assembly that can be gripped by a patient in the bed is secured to the first section. The support arm is rotatable about the vertical axis of the bracket within a predefined rotational range. The support arm defines first and second rotational positions within the predefined rotational range. In the first rotational position of the support arm, the first section is positioned above the bed and substantially parallel with the longitudinal axis of the bed. In the second rotational position of the support arm, the first section is positioned substantially transverse to the longitudinal axis of the bed.

From some embodiments, the predefined rotational range of the support arm may be approximately 180 degrees with the first rotational position of the support arm corresponding to a midpoint of the rotational range.

Yet other embodiments of the invention take the form of a patient helper apparatus that includes a bracket with a vertically extending mounting member that is mountable on a hospital bed. The mounting member includes a first bearing surface and defines a vertical axis. A support arm is provided and includes a first section defining a horizontal length and a vertically extending second section. A handle assembly grippable by a patient in the bed is secured to the first section of the support arm. The second section of the support arm defines an interior volume and has an open lower end. A second bearing surface is located in the interior volume and insertion of the mounting member through the lower open end of the support arm engages the first and second bearing surfaces. A pivot stop is operably coupled to the bracket and to the support arm. The pivot stop defines a rotational range through which the support arm is pivotable relative to the mounting member about the vertical axis defined by the mounting member.

BRIEF DESCRIPTION

The above mentioned and other features of this invention, and the manner of attaining them, will become more apparent and the invention itself will be better understood by reference to the following description of an exemplary embodiment of the invention taken in conjunction with the accompanying drawings, wherein.

Figure 1:
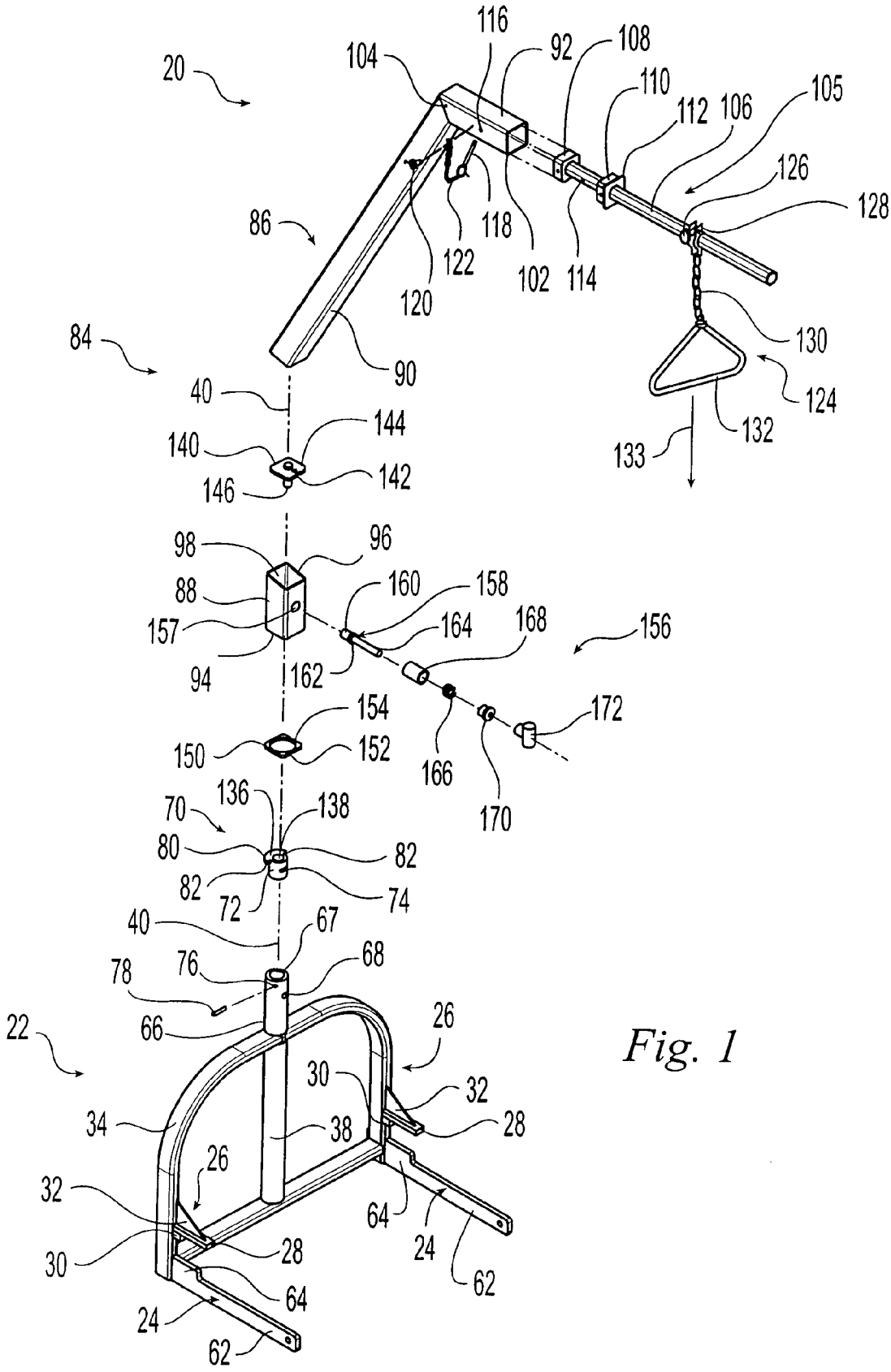
FIG. 1 is an exploded view of a patient helper apparatus.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed. In particular, it is understood that specific measurement dimensions (such as length, width, thickness, angle, diameter, etc.) disclosed herein may be adjustable for manufacturing tolerances or other reasons.

DETAILED DESCRIPTION

Figure 3:
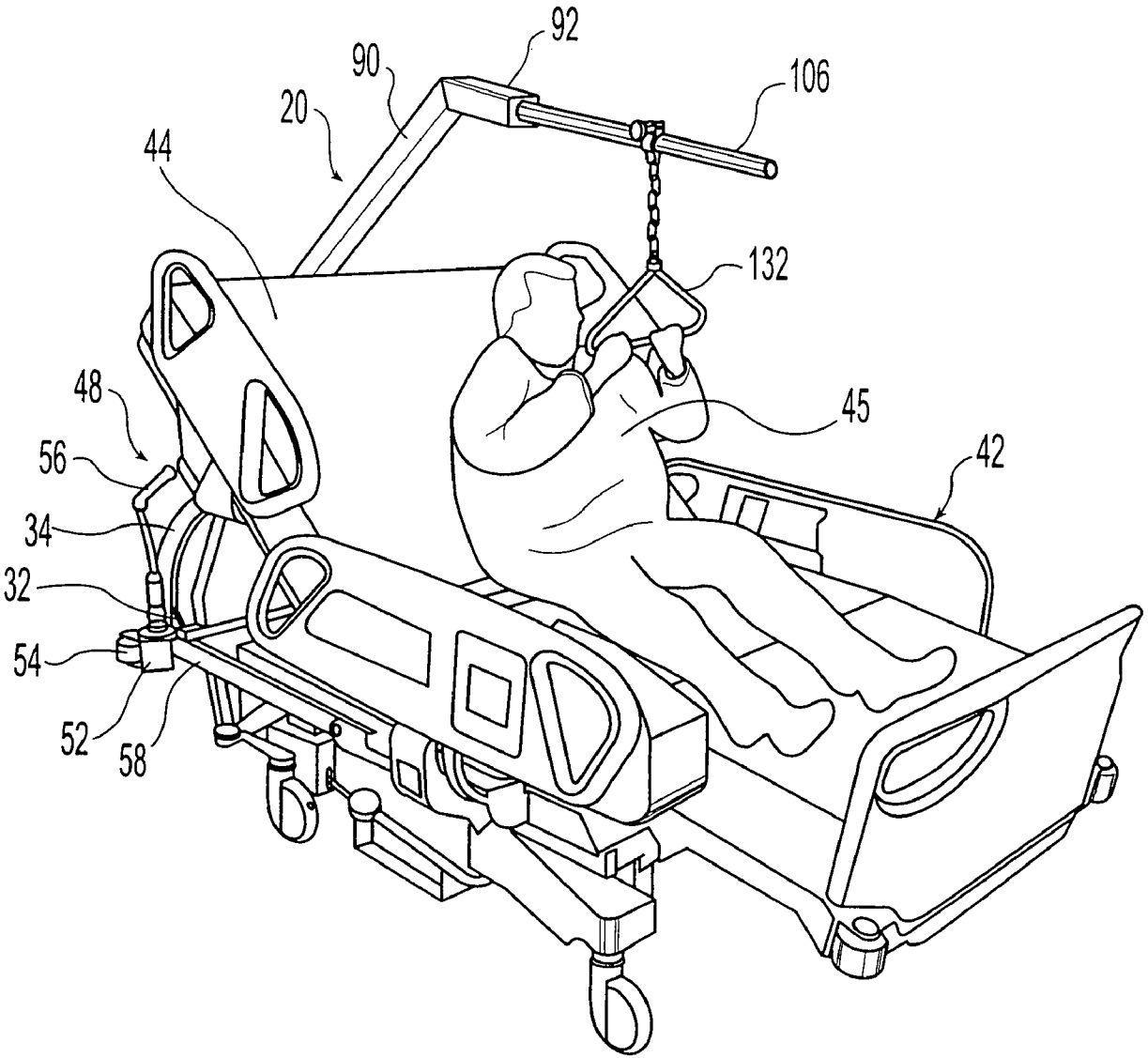
FIG. 3 is a perspective view of patient helper apparatus in use.

A patient helper 20 is illustrated in an exploded view in FIG. 1 while FIG. 3 illustrates patient helper 20 in use. In FIG. 3, a bariatric patient 45 has gripped handle 132 to enable patient 45 to reposition himself or herself on mattress 44 of hospital bed 42. Hospital bed 42 is a conventional hospital bed and, in the illustrated embodiment, is a TotalCare® Bariatric Bed commercially available from Hill-Rom Company, Inc. having a place of business in Batesville, Ind. Other hospital beds, e.g., the ExcelCare™ Bariatric Bed commercially available from Hill-Rom Company, Inc., and non-bariatric hospital beds may also be employed with the current invention.

Referring to FIG. 1, patient helper 20 includes a bracket 22 that is mountable on hospital bed 42. Bracket 22 includes lower support members 24 and mounting leg structures 26 for engaging a structure of hospital bed 42, illustratively, bed structure 46. Mounting leg structures 26 each include an outwardly extending leg 28, a spacer 30 and gusset plate 32. Gusset plates 32 are about 0.125 inch (0.318 cm) thick CRS (cold rolled steel) while legs 28 are about 0.5 inch (1.27 cm) thick 1008/1010 steel plate, have a width of about 1 inch (2.54 cm) and extend outwardly by approximately 4.375 inches (11.11 cm). Mounting leg structures 26 and lower support members 24 both extend from U-shaped bent tube 34, which is a 1008/1010 steel tube having approximately 0.234 inch (0.59 cm) thick walls. A cross member 36 extends between the opposite legs of bent tube 34 and is formed of the same material as bent tube 34. A vertically extending mounting member 38 extends from cross member 36 and through an aperture in bent tube 34. Mounting member 38 is a 4140 alloy steel tube having an outer diameter of about 2 inches (5.08 cm) and an inner diameter of about 1.25 inches (3.18 cm). An upper portion 66 of mounting member 38 extends vertically upwardly from bent tube 34 and defines a vertical axis 40. Lower support members 24 are formed of a 0.5 inch (1.27 cm) thick steel plate 1008/1010 and have a total length of approximately 18 inches (45.72 cm). Distal portions 62 extend for approximately 12.5 inches (31.75 cm) and have a height of about 1.625 inches (4.13 cm) while proximate portions 64 have a height of about 2.56 inches (6.50 cm). Lower support members 24, mounting leg structures 26, bent tube 34, cross member 36 and mounting member 38 are all welded together to form a rigid bracket structure.

Figure 2:
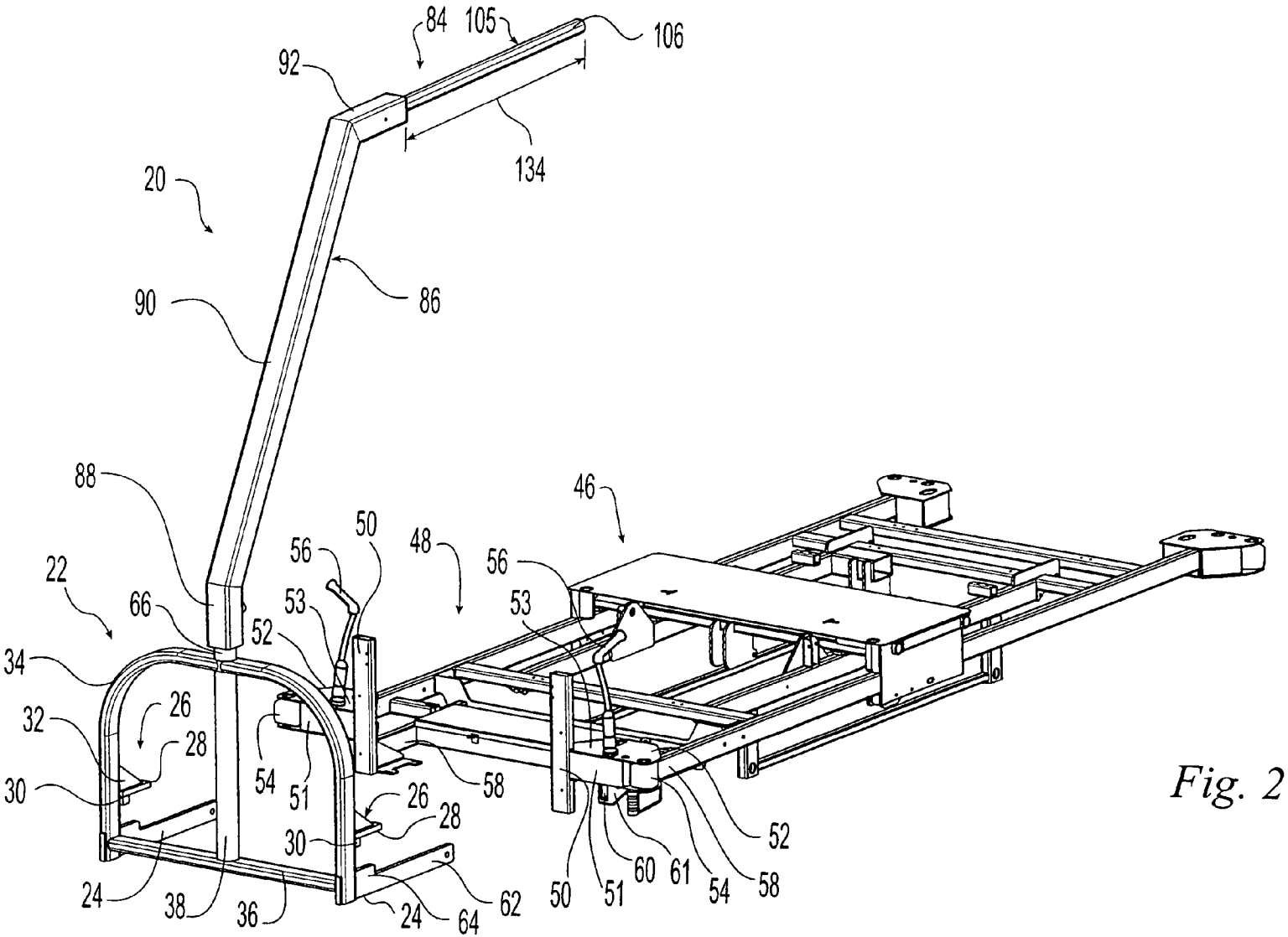
FIG. 2 is a partially exploded view of a patient helper apparatus and a bed structure.

Turning now to FIG. 2, the head end 48 of bed structure 46 includes vertically extending members 50 and laterally extending members 52 extending outwardly therefrom. Bed structure 46 is a typical hospital bed structure and includes handles 56 for moving bed 42 and bumpers 54 mounted on laterally extending members 52. Located below each of the lateral members 52 is a longitudinally extending rectangular steel tube 58. A slot 60 in plate 61 provides access to the interior of tube 58.

When mounting bracket 22 is mounted onto bed structure 46, the distal ends 62 of lower supports 24 are inserted into slots 60. The proximate portions 64 of lower supports 24 have a greater height than distal ends 62, and thereby are prevented from sliding into slots 60 and abut plate 61 when distal portions 62 have been fully inserted into tubes 58 through slots 60. As distal portions 62 of lower supports 24 are inserted into slots 60, support legs 28 slide into contact with the upper surface 53 of laterally extending members 52. When proximate portions 64 abuttingly contact plate 61 adjacent slots 60, spacers 30 contact the rear face 51 of laterally extending members 52 to thereby properly position bracket 22 relative to bed structure 46 with mounting member 38 in a vertical orientation. Bracket 22 may be held into position with release pin (not shown) going through aligning holes in tube 61 and the distal ends 62. In another embodiment, mounting bracket 22 is integrally welded into the bed structure 46.

Located near open upper end 67 of mounting member 38 is a radially oriented aperture 68 and two aligned openings 76 located along an axis (not shown) which does not pass through the center of mounting member 38. Bearing member 70 is mounted in the open upper end 67 of mounting member 38. Bearing member 70 includes a cylindrical shaft 72, a centrally located cylindrical bore 138 and radial flange 80. Bearing member 70 is formed of Delrin®, an acetal resin commercially available from E.I. Du Pont De Nemours & Co. Flange 80 has a thickness of approximately 0.25 inches (0.64 cm) and an outer diameter that corresponds to the outer diameter of mounting member 38. The inner diameter of bore 138 is about 0.75 inches (1.9 cm). Radial flange does not fully circumscribe shaft 72 and terminates at radially extending stop surfaces 82. A depression 74 is formed in shaft 72 but, as illustrated, does not intersect central bore 138. Shaft 72 has an outer diameter that corresponds to the inner diameter of support member 38 and an inner diameter of about 0.75 inches (1.9 cm). When shaft 72 is inserted in upper end 67 of mounting member 38, depression 74 is aligned with openings 76 and pin 78 is inserted therethrough to rotationally fix bearing member 70 within mounting member 338.

A support arm 84 is rotatably coupled to mounting member 38 of bracket 22. Support arm 84 includes a tubular structure 86 and extension member 105. As best shown in FIG. 2, tubular structure 86 includes a vertically extending portion 88, an inclined portion 90 and a substantially horizontally extending portion 92. Portions 88, 90 and 92 are all formed of A500 structural steel 2.5 inch (6.4 cm) square tube with about 0.125 inch (0.38 cm) thick walls which are welded together to form tubular structure 86.

Referring to FIG. 1, vertical section 88 has an open lower end 94 and an angled upper end 96 welded to inclined portion 90. Horizontal portion 92 has an open first end 102 and an opposite end 104 weldable to inclined portion 90. Inclined portion 90 forms an angle of about 62 degrees with a horizontal plane in the illustrated embodiment and horizontal section 92 is inclined at about a 2 degree angle to the horizontal with open end 102 being slightly elevated above end 104.

Open end 102 also receives extension member 105. Extension member 105 includes an octagonal shaft 106. As illustrated, shaft 106 is substantially octagonally shaped, however, it is understood that shaft 106 may be more or less cylindrical, triangular, rectangular or in shape with minimal adaptation.

In the illustrated embodiment, shaft 106 includes an outer aluminum sleeve with opposing outer faces being spaced apart by 1.25 inches (3.18 cm) and an inner cylindrical opening with a diameter of 1.08 inches (2.74 cm). An insert bar of 4140 alloy steel with a 1 inch (2.54 cm) outer diameter is located within the aluminum sleeve of shaft 106 which has an overall length of approximately 26.5 inches (67.3 cm). Mounted on the exterior of shaft 106 is a first hex plate 108 and a second hex plate 110. Both hex plates 108, 110 are formed of Delrin® and extend for approximately 1 inch (2.54 cm) along the length of shaft 106. Second hex plate 110 includes an outwardly extending lip 112 along its outer perimeter to cover the edge of open end 102 of horizontal portion 92. To mount extension 105 to horizontal portion 92, shaft 106 and hex plates 108, 110 are inserted through open end 102. When lip 112 engages open end 102, an opening 114 in shaft 106 is aligned with an opening 116 in horizontal portion 92. Pin 118 is then inserted through openings 114 and 116 to retain extension 105 within horizontal portion 92. Pin 118 is secured to horizontal section92 with a chain 122 and machine screw 120.

Handle assembly 124 is suspended from shaft 106 and provides a handle 132 that can be gripped by patient 45. A clamping structure 128 secures assembly 124 to shaft 106. A knob 126 is used to tighten and loosen clamping structure 128. When loosened, clamping structure 128 can be slid along the horizontal length 134 of shaft 106 to a desired location. In the illustrated embodiment, length 134 is approximately 20 inches (50.8 cm). Clamping structure 128 is then tightened with knob 126 to secure assembly 124 in place. A chain 130 suspends handle 132 from clamping member 126. An interlocking Spring Snap (not pictured) attaches to clamping structure 128 allowing the chain 130 to be shortened or lengthened to accommodate various arm lengths of different patients. Such handle or "trapeze" assemblies 124 are known in the art and assembly 124 has a conventional construction.

When providing a patient helper, particularly for a bariatric patient, the load (represented by arrow 133 in FIG. 1) placed on handle 132 that is used in the design of the patient helper may be at least as great as 500 pounds (227 kg). In the illustrated embodiment, a load 133 at least as great as 1000 pounds (454 kg) can be placed on patient helper 20 without failure. Support arm 84 transfers the load 133 placed on handle 132 to mounting member 38 of bracket 22 and is also rotatable relative to mounting member 38 about vertical axis 40.

To facilitate the pivotable mounting of support arm 84 on mounting member 38, vertically extending section 88 of support arm 84 includes a bearing plate 140 and a guide plate 150 mounted within the interior volume 98 of section 88. Both bearing plate 140 and guide plate 150 are about 0.25 inch (0.64 cm) thick steel plate 1008/1010 and are welded to vertical section 88. To facilitate the installation of plates 140, 150 within section 88, each plate 140, 150 includes a notch 142, 152 respectively that receives welding seam 100 which extends longitudinally on the interior surface of section 88. It is understood that suitable means other than welding may be used to couple plates 140,150 to vertical section 88.

Mounting plate 140 also includes a centrally mounted guide pin 146 and a stop pin 144 positioned radially outwardly from guide pin 146. Pins 146 and 144 are cold rolled steel having diameters of about 0.75 inches (1.9 cm) and about 0.375 inches (0.95 cm) respectively. Both pins 144, 146 are welded to mounting plate 140. Guide plate 150 is welded in place between bearing plate 140 and lower end 94 within support arm section 88. Guide plate 150 includes a central circular guide opening 154 that circumscribes the circular outer circumference of mounting member 38.

When support arm 84 is mounted on bracket 22, upper end 67 of mounting member 38 and bearing member 70 mounted therein are inserted through the lower open end 94 of section 88 and through guide opening 154 of guide plate 150. The lower surface 148 of plate 140 defines a bearing surface that is engaged with upper bearing surface 136 located on bearing member 70, guide pin 142 is inserted into central opening 138 of bearing member 70, and stop pin 144 is positioned circumferentially between radially extending stop surfaces 82.

When support arm 84 is positioned in a first, central rotational position 182 (FIG. 6), stop pin 144 is positioned substantially equidistantly between stop surfaces 82 on flange 80. As support arm 84 is rotated away from the central position 182, stop pin 144 will also be rotated toward one of the stop surfaces 82 on radially extending flange 80. Support arm 84 can be rotated away from central position 182 until stop pin 144 engages one of the stop surfaces 82 which together act as a pivot stop limiting the relative rotation between support arm 84 and mounting member 38. Flange 80 extends through an arc of about 153.2 degrees which allows the center of stop pin 144 to rotate through a range of approximately 180 degrees. Arrows 180 in FIG. 6 illustrate the corresponding 180 degree rotational range of support arm 84.

Figure 6:
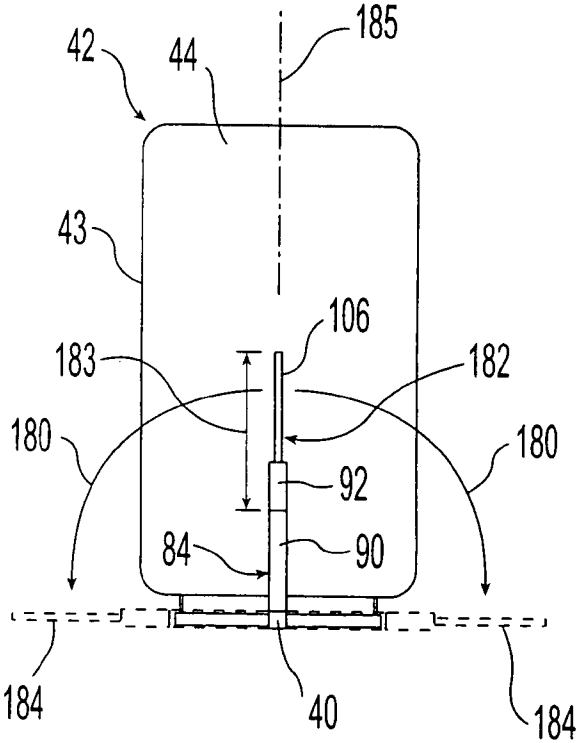
FIG. 6 is a schematic plan view of a hospital bed and patient helper apparatus.
Figure 5:
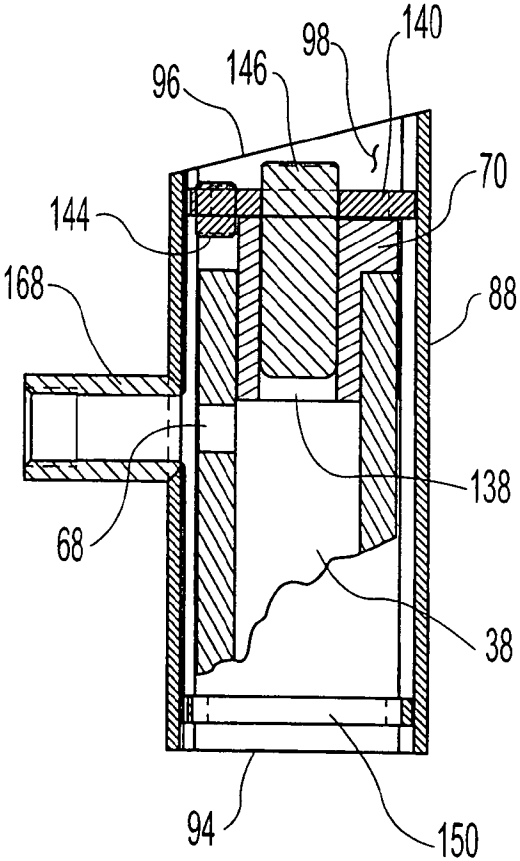
FIG. 5 is a sectional view taken along line 5-5 of FIG. 4.

As seen in FIG. 6, the substantially horizontal section of support arm 84, which includes both horizontal portion 92 of tubular structure 86 and extension 105, extends for a horizontal length 183. This horizontal section 183 is positioned parallel to and in alignment with longitudinal axis 185 of hospital bed 42 when support arm 84 is in its first central rotational position. As described above, support arm 84 can be rotated 90 degrees in either direction from first rotational position 182 about vertical axis 40. Rotating vertical section 88 of support arm 84 about axis 40 by 90 degrees from central position 182 will position horizontal section 183 of support arm 84 at a substantially transverse angle to longitudinal axis 185 as depicted by transverse positions 184 illustrated in dashed outline in FIG. 6. As schematically depicted in FIG. 6, rotating support arm 84 such that horizontal section 183 is positioned transverse to longitudinal axis 185 positions horizontal section 183 outwardly of the outer perimeter 43 of hospital bed 42. In other words, rotating support arm 84 by 90 degrees from its central position 182 will position support arm 84 such that horizontal section183 is no longer positioned above hospital bed 42. In the illustrated embodiment, the entire support arm structure 84 is located outwardly of the outer perimeter 43 when support arm 84 is placed in a transverse position 184. Repositioning support arm 84 in this manner allows it to be moved out of the way when providing health care to patient 45 or to provide access for diagnostic equipment without having to remove the relatively heavy tubular support structure 86 from mounting member 38.

It is further noted that when support arm 84 has been rotated to a transverse position 184, extension 105 can be easily removed by pulling pin 118 and removing extension 105 from horizontal portion 92 of tubular structure 86. Removal of extension 105 from tubular structure 86 can further diminish the obtrusiveness of patient helper apparatus 20 when it is not in use.

Although the illustrated embodiment allows support arm 84 to be rotated through a range of 180 degrees, 90 degrees in either direction from central position 182, other embodiments could utilize other predefined rotational ranges such as 90 degrees. In such an embodiment having a rotational range of 90 degrees, the support arm would be rotatable from central position 182 to only one of the transverse positions 184.

A spring-loaded quick release mechanism 156 is provided to releasably secure the support arm in its central position 182. In the illustrated embodiment, mechanism 156 is a weld-in quick pin, such as assembly part no. 90222A116 commercially available from McMaster-Carr Supply Company having a place of business in Atlanta, Ga. Mechanism 156 includes a pin 158 having a first cylindrical portion 160, a radial flange 162, and a second cylindrical portion 164. A spring 166 is mounted on cylindrical portion 164 within sleeve 168. As illustrated, sleeve 168 is welded to support arm section 88 at an opening in section 88 to mount mechanism 156 to support arm 84. A knob 170 is fixed to one end of sleeve 168 and traps spring 166 between knob 170 and flange 162 within sleeve 168. Second cylindrical portion 164 extends outward of knob 170 where it is engaged with handle 172. Spring 166 biases pin. 158 inwardly whereby cylindrical portion 160 is inserted through aperture 157 in vertical section 88 and into aperture 68 in mounting member 38 when support arm 84 is in its central position 182 and pin 158 is aligned with aperture 68. To release pin158 from aperture 68, handle 172 is pulled outwardly, thereby permitting the rotational movement of support arm 84 relative to mounting member 38. Thus, support arm 84 is releasably secured in a predefined rotational position by inserting pin 158 into aperture 68 and can be released from this position by toolless manual manipulation, i.e., pulling handle 172 outwardly without the use of tools.

Although the illustrated embodiment includes only one aperture 68 for engagement with pin 158, additional apertures could be located to correspond to transverse positions 184 of support arm 84 to releasably secure support arm 84 in such a transverse position.

Figure 4:
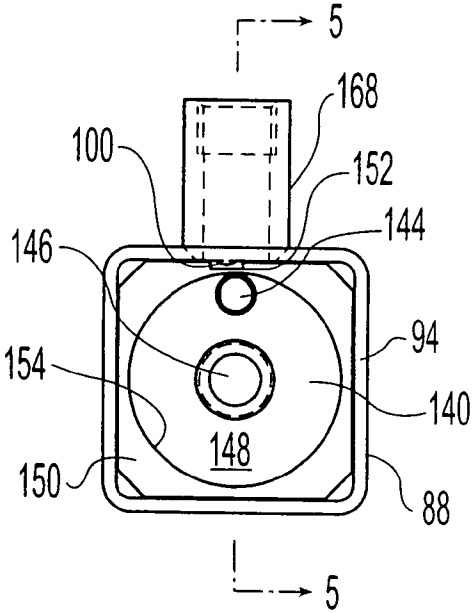
FIG. 4 is a bottom view of a support arm.

As described above, patient helper 20 transfers a load 133 applied to handle 132 by patient 45 to bed structure 46. This load is transferred through shaft 106 and tubular structure 86 to mounting member 38 of bracket 22. Bracket 22 then transfers the load to bed structure 46 through mounting legs 28 and lower support members 24. At the junction between tubular structure 86 and mounting member 38, this load is transferred from a structure 88 having a rectilinear cross section, as best seen at opening 94 in FIG. 4, to a structure 38 having a circular cross section, as best seen at opening 67 in FIG. 1, wherein the two structures 88, 38 are also relatively rotatable. As mentioned above, a vertical load (parallel to axis 40) is imparted from support arm 84 to mounting member 38 through the mutual engagement of bearing surfaces 148, 136 located on bearing plate 140 and bearing member 70 respectively. The moment forces generated by load 133 are resisted by axially spaced forces oriented transverse to axis 40 and applied to mounting member 38 by guide plate 150 and to mounting member 38 through bearing member 70 by guide pin 142. Thus, guide plate 150 and guide pin 142 resist the tilting of support arm 84 as load 133 is applied. Similarly, guide plate 150 and guide pin 142 retain vertical section 88 in a vertical orientation as support arm 84 is rotated between positions 182 and 184.

Although the materials and dimensions of the illustrated embodiment have been described with some specificity, alternative embodiments of the present invention may utilize other appropriate materials having alternative dimensions. Thus, while this invention has been described as having an exemplary design, the present invention may be further modified within the spirit and scope of this disclosure. This application is therefore intended to cover any variations, uses, or adaptations of the invention using its general principles.

What is claimed is:

1. A patient helper apparatus comprising:

a bracket mountable to a bed, a portion of the bracket defining a vertical axis extending substantially perpendicular to a longitudinal axis of a bed;

a support arm coupled to the bracket and configured to rotate about the vertical axis within a predefined rotational range, the support arm including a substantially horizontal first section positionable above and substantially parallel to the longitudinal axis of the bed when the support arm is in a first position and substantially transverse to the longitudinal axis of the bed when the support arm is in a second position;

a quick-release mechanism comprising a pin insertable into an aperture defined by the support arm and insertable into an aperture defined by the bracket to releasably secure the support arm in a predefined rotational position; and a handle assembly movably coupled to the first section of the support arm and configured to be gripped by a patient in the bed.

2. The patient helper apparatus of claim 1, wherein the support arm is releasably coupled to the bracket in the first position.

3. The patient helper apparatus of claim 1, wherein the first section is positionable outwardly of an outer perimeter of the bed in the second position.

4. The patient helper apparatus of claim 1, wherein the predefined rotational range between the first position and the second position along the vertical axis is defined by at least about 90 degrees.

5. The patient helper apparatus of claim 1, wherein the support arm is further configured to rotate to a third position about the vertical axis within the predefined rotational range, and the predefined rotational range between the second position and the third position along the vertical axis is defined by at least about 180 degrees.

6. The patient helper apparatus of claim 5, wherein the first position defines an approximate midpoint between the second position and the third position along the vertical axis of the predefined rotational range.

7. The patient helper apparatus of claim 1, wherein the support arm is configured to support a load comprising a bariatric patient.

8. A patient helper apparatus comprising:

a bracket including a mounting portion mountable to a bed;

a mounting member coupled to the bracket and defining an axis extending substantially upwardly away from the mounting portion of the bracket;

a support arm pivotably coupled to the bracket, the support arm including a substantially horizontal first section;

a handle assembly movably coupled to the first section of the support arm and configured to be gripped by a patient using the bed; and a pivot stop operably coupled to the bracket and the support arm, the pivot stop defining a rotational range through which the support arm is pivotable relative to the mounting member about the vertical axis; wherein the mounting member comprises a first bearing surface configured to mutually engage a second bearing surface within an interior volume of a substantially vertically extending second section of the support arm by extending the mounting member into the interior volume through an opened lower end of the second section; a bearing plate is mounted in the interior volume, the second bearing surface is disposed on the bearing plate; and wherein the pivot stop comprises a pivot pin mounted on the bearing plate.

9. The patient helper apparatus of claim 8, wherein the first section of the support arm is positionable above and substantially parallel to a longitudinal axis of the bed when the support arm is in a first position and substantially transverse to the longitudinal axis of the bed when the support arm is in a second position.

10. A patient helper apparatus comprising:

a bracket including a mounting portion mountable to a bed;

a mounting member coupled to the bracket and defining an axis extending substantially upwardly away from the mounting portion of the bracket;

a support arm pivotably coupled to the bracket, the support arm including a substantially horizontal first section;

a handle assembly movably coupled to the first section of the support arm and configured to be gripped by a patient using the bed; and a pivot stop operably coupled to the bracket and the support arm, the pivot stop defining a rotational range through which the support arm is pivotable relative to the mounting member about the vertical axis; wherein the mounting member comprises a first bearing surface configured to mutually engage a second bearing surface within an interior volume of a substantially vertically extending second section of the support arm by extending the mounting member into the interior volume through an opened lower end of the second section; a bearing plate is mounted in the interior volume, the second bearing surface is disposed on the bearing plate; and a guide pin is mounted on the bearing plate, the mounting member defining a central opening for rotatably receiving the guide pin, the guide pin being aligned with the vertical axis when disposed within the central opening.

11. The patient helper apparatus of claim 10, wherein the mounting member includes a tubular member having an upper opened end and a bearing member, the bearing member having a central shaft insertable into the upper open end and defining the central opening.

12. The patient helper apparatus of claim 11, wherein the bearing member further includes a radial flange engageable with the tubular member and defining the first bearing surface.

13. The patient helper apparatus of claim 12, wherein the pivot stop comprises a pivot pin mounted on the bearing plate, the radial flange partially circumscribing the central shaft and including two radially extending stop surfaces engageable with the pivot pin.

14. A patient helper apparatus comprising:

a bracket including a mounting portion mountable to a bed;

a mounting member coupled to the bracket and defining an axis extending substantially upwardly away from the mounting portion of the bracket;

a support arm pivotably coupled to the bracket, the support arm including a substantially horizontal first section;

a handle assembly movably coupled to the first section of the support arm and configured to be gripped by a patient using the bed; and a pivot stop operably coupled to the bracket and the support arm, the pivot stop defining a rotational range through which the support arm is pivotable relative to the mounting member about the vertical axis; wherein the mounting member comprises a first bearing surface configured to mutually engage a second bearing surface within an interior volume of a substantially vertically extending second section of the support arm by extending the mounting member into the interior volume through an opened lower end of the second section; a bearing plate is mounted in the interior volume, the second bearing surface is disposed on the bearing plate; and an alignment plate is mounted in the interior volume between the bearing plate and the open lower end, the alignment plate defining an alignment opening and the mounting member rotatably extending through the alignment opening.

15. The patient helper apparatus of claim 14, wherein the mounting member defines a substantially circular cross section and the second section defines a substantially rectilinear cross section.

16. The patient helper apparatus of claim 15, wherein the mounting member includes a tubular member having an upper open end and a bearing member, the bearing member having a central shaft insertable into the upper open end and defining a central opening.

17. The patient helper apparatus of claim 16, wherein the bearing member further includes a radial flange engageable with the tubular member and defining the first bearing surface.

18. The patient helper apparatus of claim 17, wherein the pivot stop comprises a pivot pin mounted on the bearing plate, the radial flange partially circumscribing the central shaft and including two radially extending stop surfaces engageable with the pivot pin.

* * * * *